US005686729A

United States Patent [19]

Bittar et al.

[11] Patent Number: 5,686,729

[45] Date of Patent: Nov. 11, 1997

[54] DEVICE FOR COUNTING PRODUCTS STACKED SIDE-BY-SIDE

[75] Inventors: Bachar Bittar, Paris; Dominique Perdoux, Mardle, both of France

[73] Assignee: Gilles Leroux S.A., Loury, France

[21] Appl. No.: 420,006

[22] Filed: Apr. 11, 1995

[30] Foreign Application Priority Data

Apr. 11, 1994 [FR] France ..... 94 04213

[51] Int. Cl.[6] ..... G06M 9/00

[52] U.S. Cl. ..... 250/559.04; 250/559.29; 250/559.4; 250/224; 377/8

[58] Field of Search ..... 250/559.04, 559.08, 250/559.29, 559.4, 223 R, 224, 234; 377/6, 8, 10, 17

[56] References Cited

U.S. PATENT DOCUMENTS 3,573,477 4/1971 Klapes ..... 250/223 R
4,373,135 2/1983 Mohan et al. ..... 377/8

FOREIGN PATENT DOCUMENTS 0 294 735 12/1988 European Pat. Off. .
2 680 027 2/1993 France .
WO 91/05317 4/1991 WIPO .

*Primary Examiner*—Stephone Allen
*Attorney, Agent, or Firm*—Nixon & Vanderhye

[57] ABSTRACT

This invention relates to a device for counting products (1) that are thin, stacked side by side and arranged edgewise in trays (2) packaged under a translucent shrink-on film, characterized in that it comprises:

means (7) for illuminating the tray;

means (91) for detecting the positioning of a tray on a mobile shuttle (81, 21) driven with a displacement movement;

means (4, 5, 6) for performing multiple scannings of the tray by a linear reading beam of a linear camera during the displacement in a direction that is perpendicular to the linear beam;

means for storing the light data contained in the linear beam, and counting means for each scanning of the number of products.

14 Claims, 7 Drawing Sheets

DEVICE FOR COUNTING PRODUCTS STACKED SIDE-BY-SIDE

BACKGROUND OF THE INVENTION

This invention relates to a device for counting products that are thin and stacked side by side.

Devices are known for counting products using a matrix camera; such devices require the setting up of a calibration procedure, thus resulting in complex and costly apparatus.

BRIEF DESCRIPTION OF THE INVENTION

The object of the invention is therefore to propose a counting device which is simple and low-cost and which makes it possible to read products arranged in batches under a translucent shrink-on film.

This object is achieved by the fact that the device for counting thin products that are stacked side-by-side and arranged edgewise in trays packaged under translucent shrink-on film is characterized in that it comprises:

means for illuminating the tray;

means for detecting the positioning of a tray on a mobile shuttle driven with a displacement movement;

means for performing multiple scannings of the tray by a linear reading beam of a linear camera during the movement in a direction that is perpendicular to the linear beam;

means for storing the light data contained in the linear beam, and counting means for each scanning of the number of products.

According to another feature, the displacement movement of the shuttle is a back-and-forth movement produced by an electric motor whose drive-shaft is connected to the shuttle, which is made integral with linear guide columns, by a mechanism for transforming the rotary movement into a transmitted linear movement.

According to another feature, the movement of the tray is produced by a cleated belt supporting a number of trays driven by a continuous movement in a direction that is transverse to the linear read beam.

According to another feature, a push-button that can be actuated by the user initiates a displacement and, during this displacement, the multiple scannings.

According to another feature, the storage means consist of as many eight-bit storage bytes as there are photosensitive elements of the reading bar of the camera.

According to another feature, the number of photosensitive elements is at least more than double the maximum number of objects that the device can count.

According to another feature, the number of photosensitive elements is preferably equal to ten times the maximum number of objects that the device can count.

According to another feature, the linear beam is sent back by a number of mirrors to ensure, with a compact device, the scanning of a tray of large size.

According to another feature, each photosensitive element makes it possible to detect 256 levels of brightness, which are translated into words of one eight-bit byte constituting the representation of a pixel.

According to another feature, the counting means make it possible to detect alternately the peaks and valleys, starting with a peak detection, and to count the peaks and valleys that make up the representative stored sine-wave signal of the linear beam.

According to another feature, the detection of the peaks ensures the detection of the first edge and the determination of the peaks by measuring the distance between the preceding peak and the pixel being processed and by comparing the distance with a minimum value that corresponds to the thickness of a product and also comprises a step for calculating the percentage of variation of the peak which makes it possible, in case where the percentage exceeds a set value, to determine the presence of an edge.

According to another feature of the invention, the detection of the valleys is performed in relation to the stored preceding peak by measuring the distance between the peak and the processed pixel and in relation to the stored preceding valley by measuring the distance between the valley and the processed pixel and by assuming that the pixel forms a valley if the two distances are proper compared to reference values and, in the opposite case, by processing the next pixel.

BRIEF DESCRIPTION OF THE DRAWINGS

Other features and advantages of this invention will come out more clearly on reading the description below of an embodiment given by way of example and made with reference to the accompanying drawings where.

DETAILED DESCRIPTION OF THE INVENTION

Figure 1:
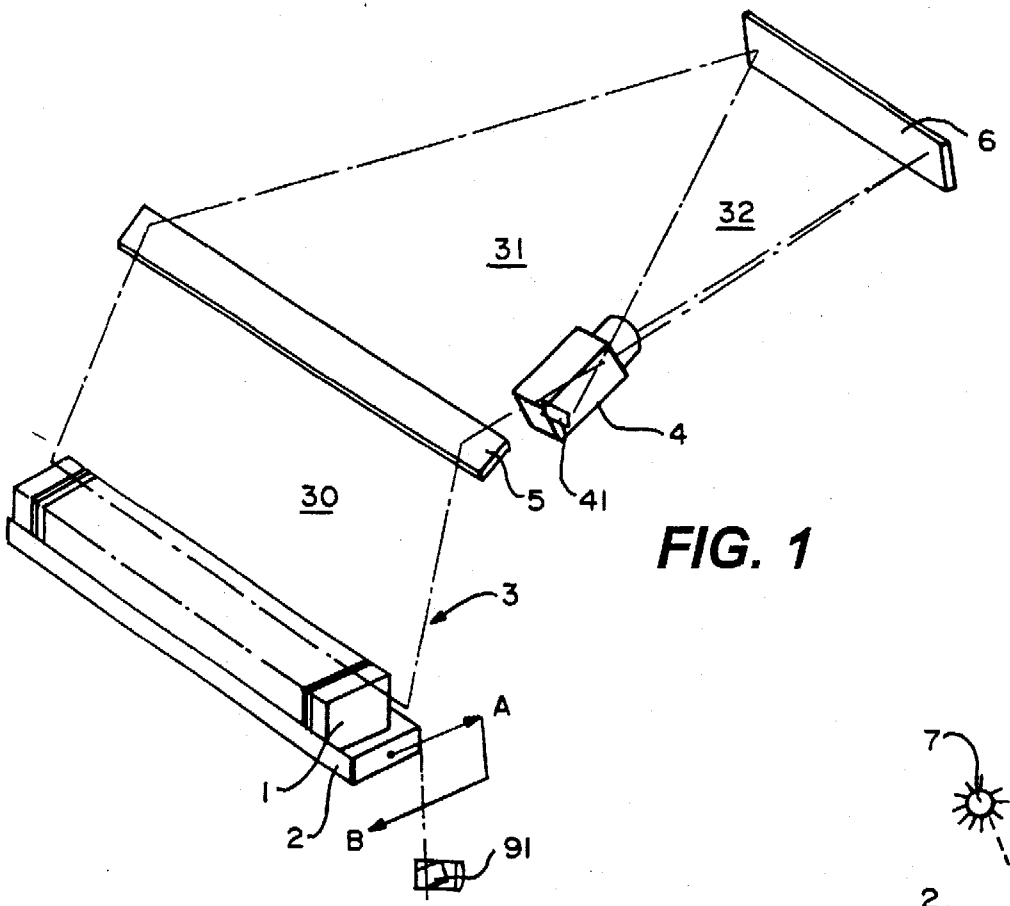
FIG. 1 shows a perspective view of the mechanical and optical principle of the counting machine.
Figure 2:
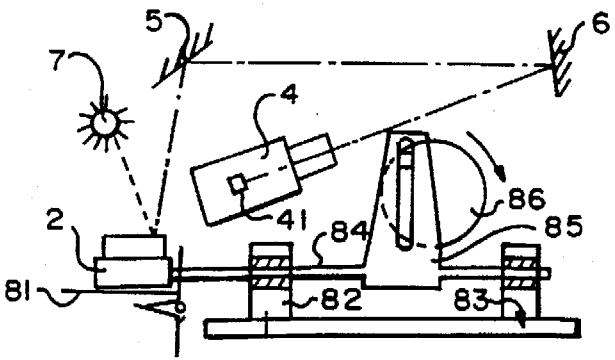
FIG. 2 shows a diagrammatic side view of the mechanical principle of the machine.

The invention will now be described in connection with FIGS. 1 to 9 and in particular with FIGS. 1 and 2 which depict the mechanical part, which consists of a support (81, FIG. 2) on which trays (2) containing a stack (1) of products such as magnetic or smart cards, access badges, tickets, paper files, envelopes, etc., the batch of product being packaged in a translucent shrink-on film, not shown, can be placed.

Tray (2) is illuminated by a fluorescent tube (7) and the light beam reflected on the batch of objects (1) to be counted and sent to a reflecting device, comprising a first mirror (5) and a second mirror (6) for making the beam converge on a small linear bar (41) of photosensitive elements belonging to a camera (4). The beams (32, 31, 30) represent the light beam which converges toward the small bar of photosensitive elements (41). This small bar (41) comprises, by way of example, 5,000 elements to make it possible to read a tray containing, for example, a maximum of 500 products. Each photosensitive element of the small bar makes it possible to detect a light signal and to express this signal in the form of a representative electric signal of 256 levels of brightness. This signal is translated into words consisting of, for example, 8 bits, and each word is recorded in a storage element of the device. Thus, the memory of the device consists, for the example given, of a random access memory of 5000 words of one eight-bit byte. The planar light beam (30) represents a scanning, and the device makes it possible for the camera to perform multiple scannings that are transverse to the displacement of tray (2) represented by arrows A and B and that are ensured by a mechanism depicted, for example, in FIG. 2. This mechanism consists of a support (81) made integral with two columns (84), each mounted to slide in two bearings mounted on feet (82, 83). At least one of columns (84) comprises a reversing part (85) which makes it possible to ensure the transformation from a rotation movement imparted by an electric motor (86) into a linear movement that is communicated to columns (84). The object of this device is to ensure a back-and-forth movement which makes it possible-at each cycle initiation caused by the depressing of a push-button, not shown, placed on the hood of the machine—to have a back-and-forth displacement performed at the tray (2), as shown in FIG. 1. A switch (91) makes it possible to detect the presence of a tray (2) and to validate the read sequences performed during the multiple scannings, as well as the countings of the products.

Figure 9:
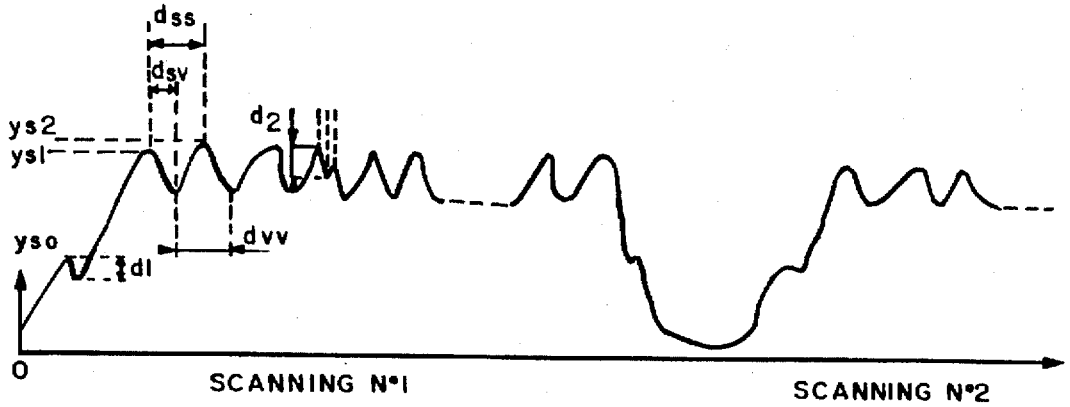
FIG. 9 shows the shape of the signal that is output by the photosensitive elements and is stored in the form of eight-bit bytes in the memory of the camera.

As indicated below, during a forward displacement camera (4) performs 50 scannings, which are carried out alternately left-to-right and right-to-left, and during the return displacement it carries out another 50 alternate scannings. As shown in FIG. 9, during each scanning, the light signal recorded by the photosensitive elements consists of a sine-wave signal whose peaks represent approximately the centers of the products, the valleys, and the edges, and the distance separating two valleys corresponds to the thickness of one product to be counted. The first peak with coordinates ys0 corresponds in fact to a detection edge of the tray, while first peak ys1 corresponds to the first product to be counted.

Between scanning No. 1 and scanning No. 2, a microprocessing device that is controlled by a program using the algorithms described below makes it possible to perform the processing of the data stored during the first scanning before validating the storing of a second scanning, shown in FIG. 9.

Figure 3:
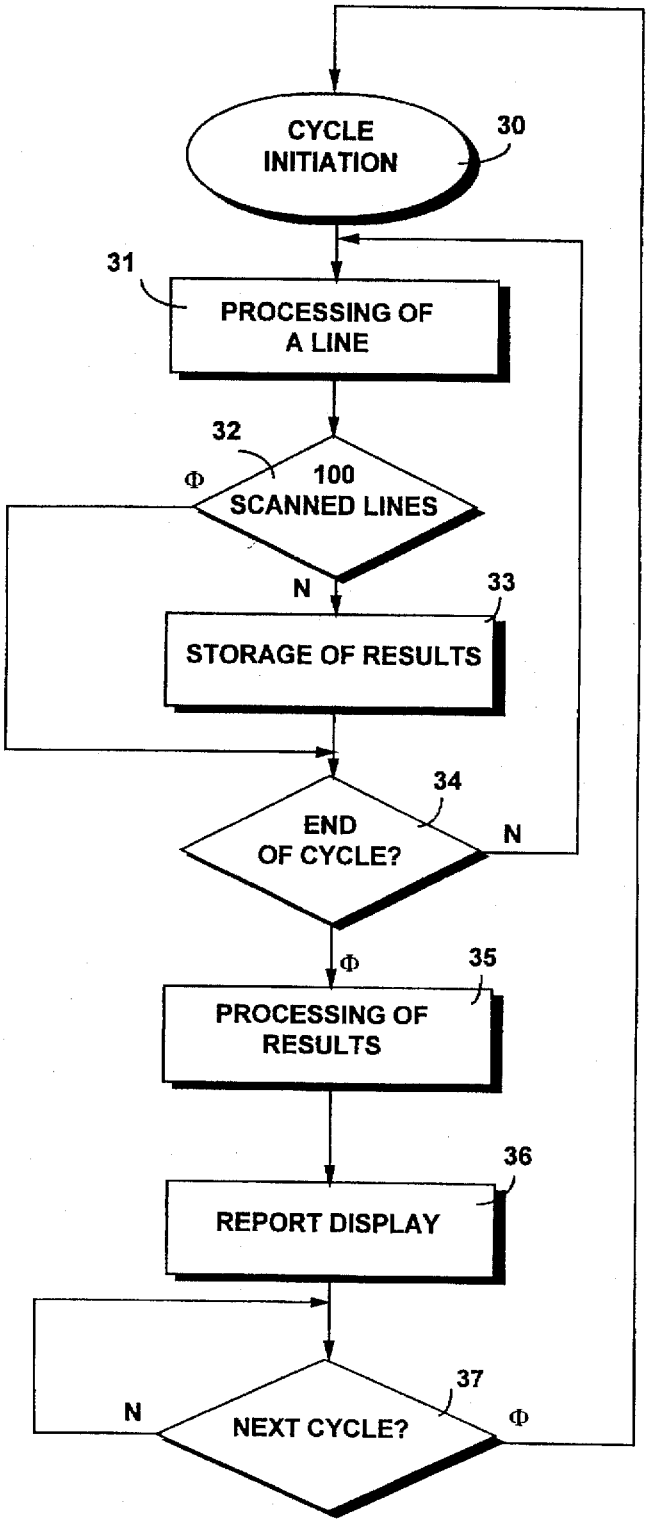
FIG. 3 shows the representative flowchart of the sequence of the counting operation.
Figure 4:
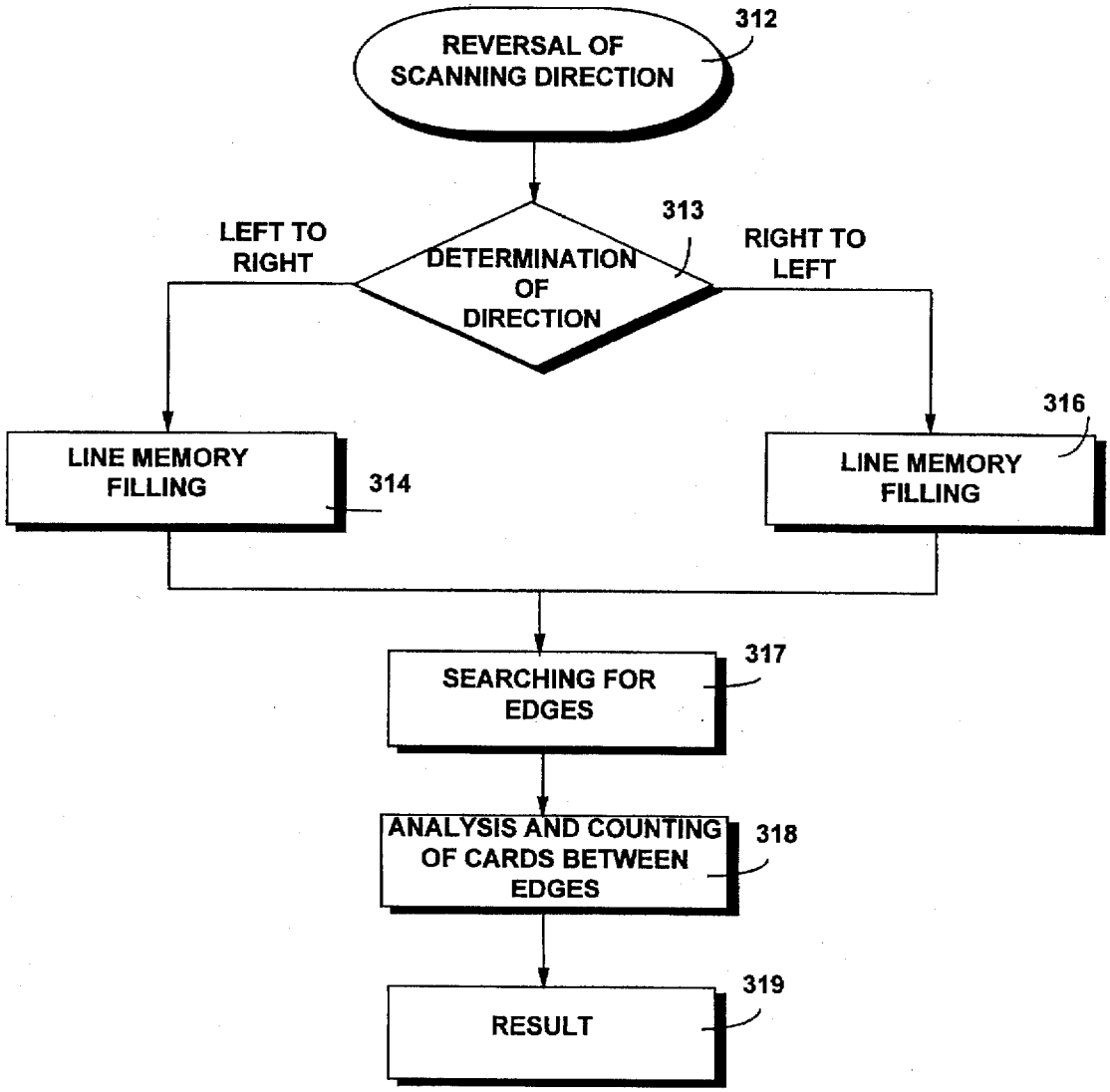
FIG. 4 shows the representative flowchart of the processing of one line.

The program for reading the stored scannings and for counting the products corresponds to the use of the algorithms shown in FIGS. 3 to 7. In FIG. 3, after the cycle initialization, which is detected by the depressing of the push-button by the user, represented in step (30), the program performs the processing of a line represented in step (31), and after this line processing a test is performed, represented in step (32), to determine whether a specified number of lines, for example, have been scanned. If the answer is no, the result is stored in step (33), and if it is yes, the program jumps to step (34), which is a test to determine whether it is an end of cycle. If the test is negative, the program loops back before step (31). If the test is positive, i.e., if the scanning counter indicates that the specified number of linear scannings has been performed, the program moves on to step (35), which is a step for processing results. The next step (36) consists of the displaying of the report. A test, represented in step (37), indicates whether a next cycle should be performed. If the answer is no, the program loops back on itself between steps (36) and (37), and if it is yes, the program loops back to cycle initialization. This "next cycle" test consists of the detection of the depressing of the push-button. Line processing step (31) corresponds to the series of steps shown in FIG. 4, and this sequence begins with a reversal of the direction of scanning (312) and continues on to test step (313) involving the determination of the direction. In the case of a scanning from left to right, the filling of the line memory is done in step (314) and, in the other case of scanning from right to left, the filling of the line memory is also done by a step (316).

Figure 5:
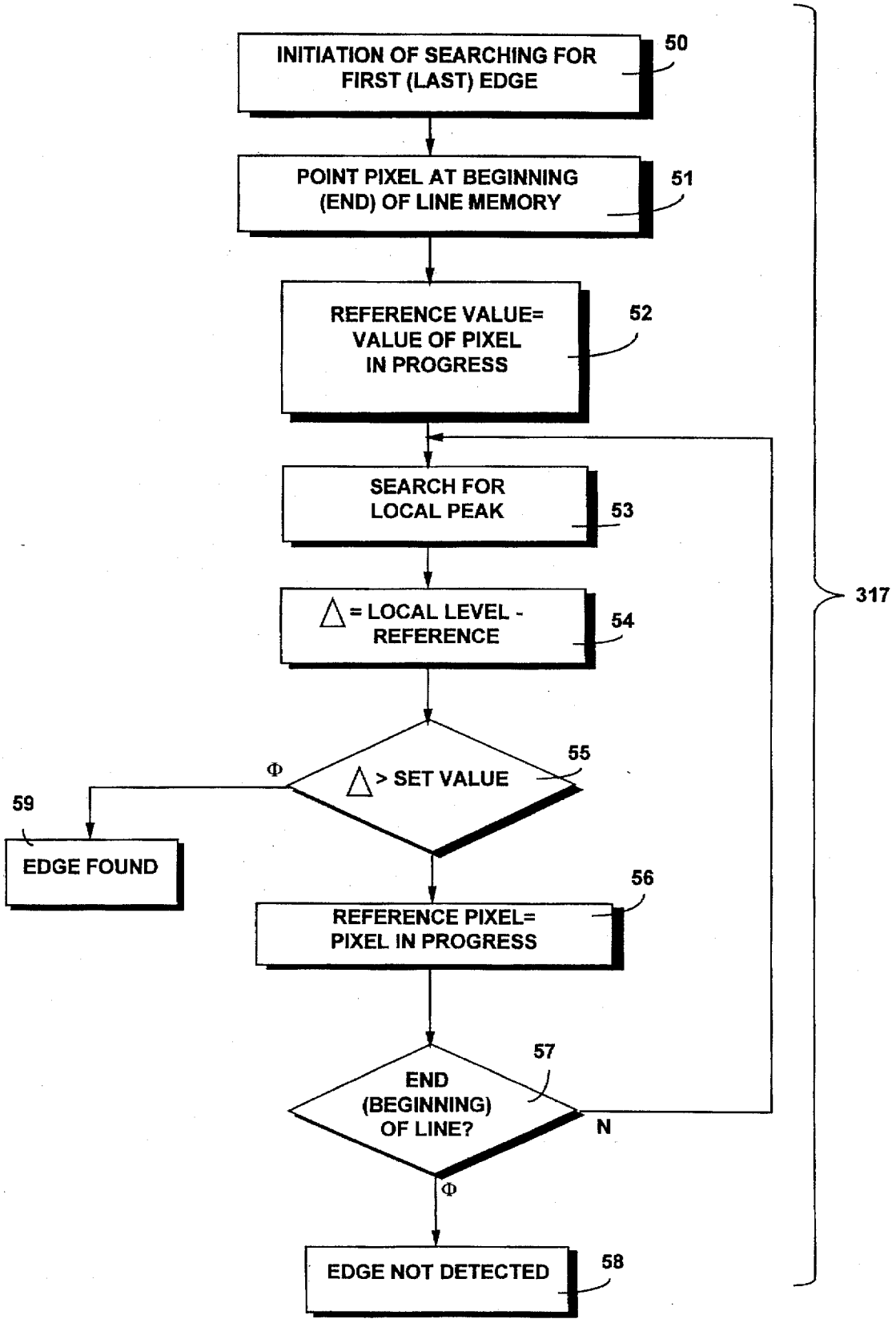
FIG. 5 shows the representative flowchart of the process for locating the edges of the box containing the products.

A step (317) for searching for the edges of the tray follows each of these memory filling steps, and a step (318) of analysis and counting of the products between the edges follows this step. The program ends with the processing of the results, represented in step (319), for each of the lines. The sequence of searching for edges is represented by step (317); its steps are depicted in FIG. 5. This sequence begins with a step 51 for incrementing a "pixel" image point pointer, making it possible to determine whether one is at the beginning or the end of the stored data corresponding to each of the photosensitive cells of the line. When the processing of 5,000 memory words is completed, the processing of one line memory is performed.

Following this step is a step 52 of loading the reference value, which is equal to the value of the pixel whose processing is in progress. This information consists of an 8-bit word that is representative of one of the 256 levels of brightness received by the photosensitive element corresponding to the processed memory word.

Following this step is a step 53 for local searching of peaks, which is followed by a step 54 for calculating the difference between the local level and the reference value stored in step 52.

Following this step 54 is a test step 55, involving the value of the difference to determine whether this difference is greater than a set value. If the answer is yes, the program knows, in step 59, that an edge has been found. If it is no, the program continues on to step 56 for storing of the pixel being processed as a reference pixel, Following this step is a test step 57 determining if it is the end or beginning of a line by comparing the counter of the pixel pointer to determine whether the latter has reached the defined value fixed at 5,000 for the example or not. If the answer is yes, the program displays "edge not detected" in step 58 while positioning a semaphore used in step 75 of FIG. 7, and if the answer is no, the program loops back to before local peak search step 53.

The set value of step 55 corresponds in general to the distance which on average separates a peak from a valley and, as can be seen in the diagram of FIG. 9, the program of FIG. 5 makes it possible to detect as an edge the peak Ys0 thus, as will be seen later, during the processing of the valley, upon ascertaining that the distance d1 between the peak and the following valley is less than another set value and the percentage of variation of the peaks is greater than a specified value, it assumes that it is not the edge of the tray and detects the next peak YS1 as being the actual edge of the tray.

Figure 6:
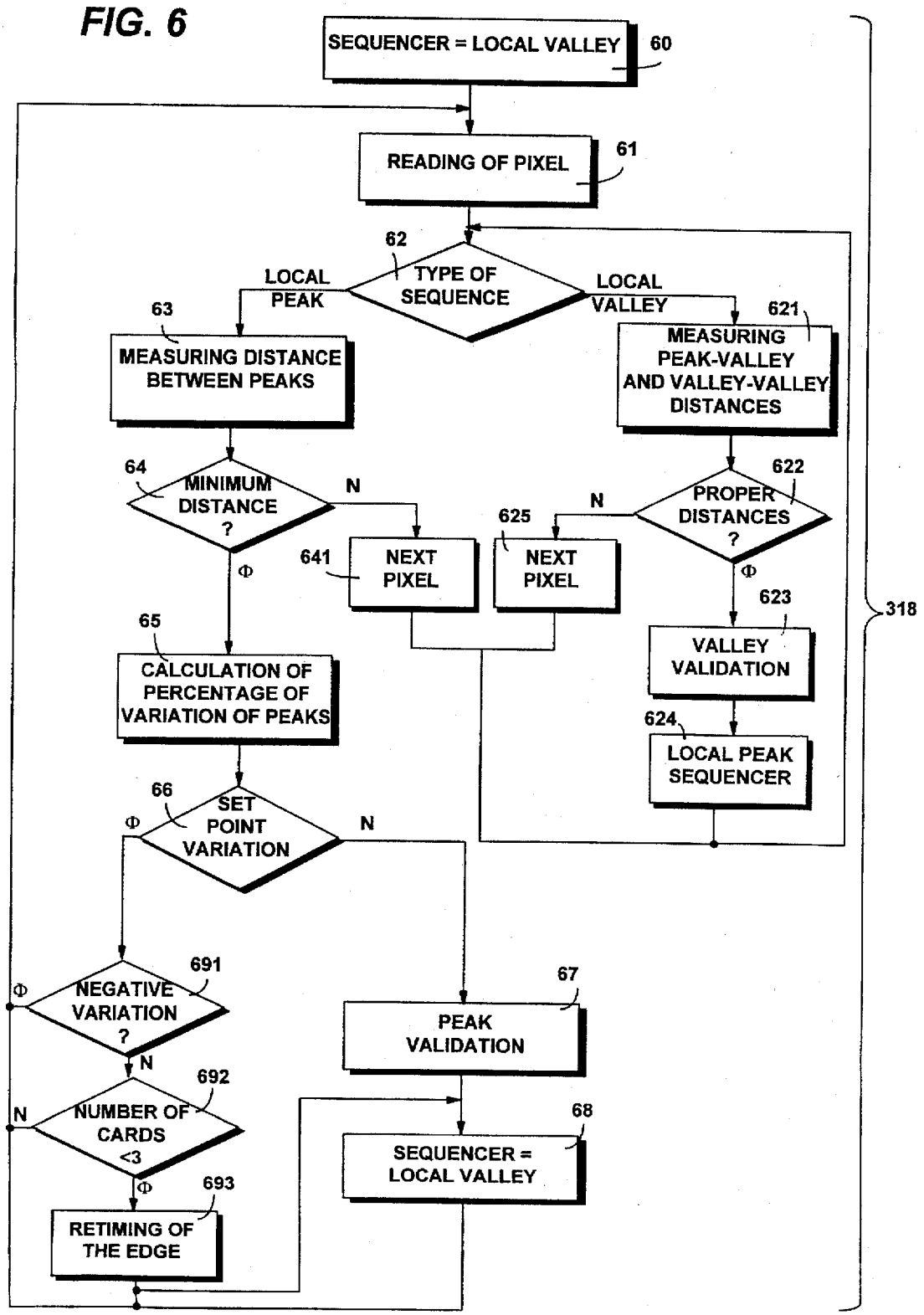
FIG. 6 shows the representative flowchart of the process of analysis and counting of the products.
Figure 7:
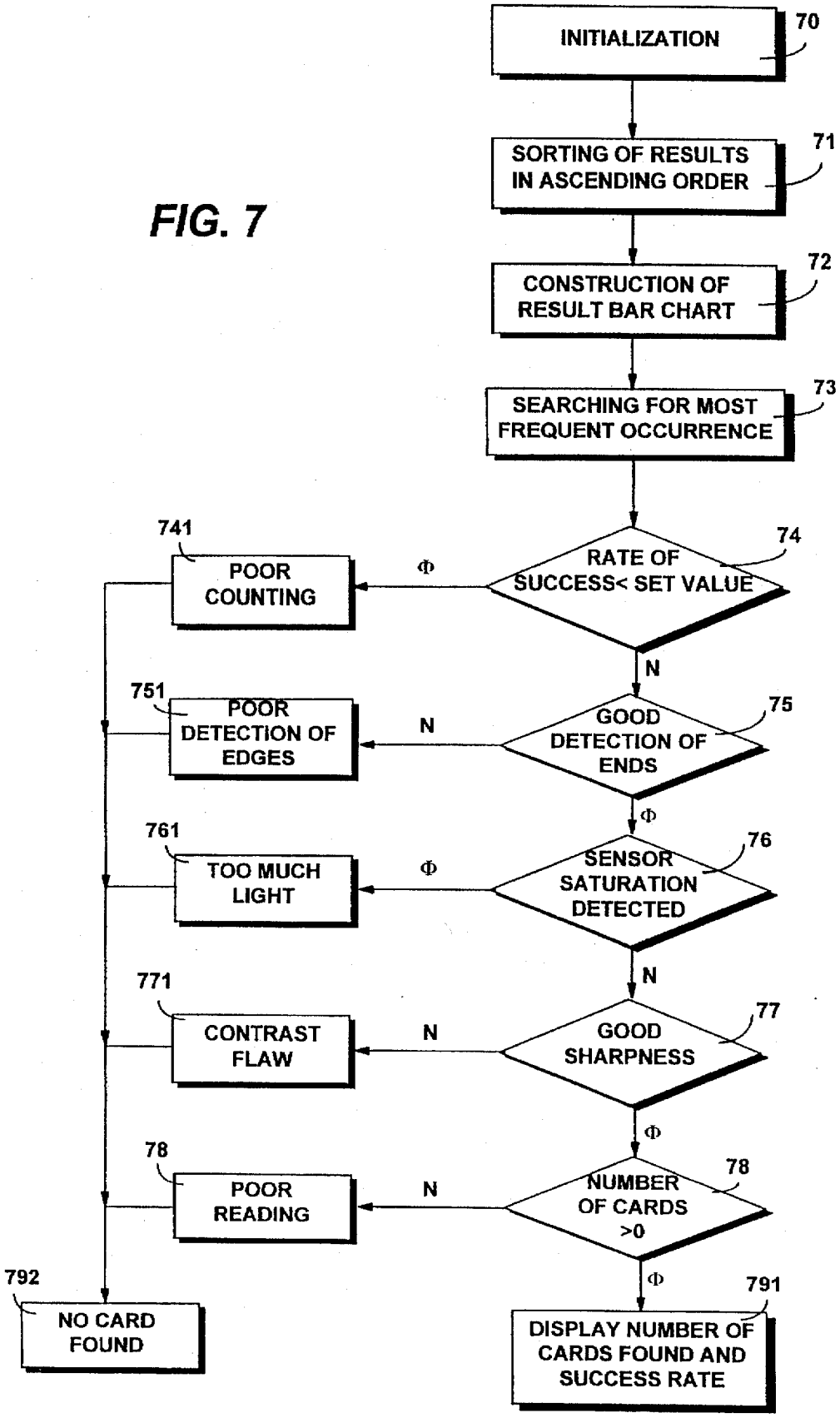
FIG. 7 shows the representative flowchart of the process of analysis and processing of the results.

Sequence 318 of analysis and counting of the products between the edges corresponds to the steps represented in FIG. 6 which begin with a step 61 for reading of a pixel, to be followed by a test step 62 concerning the type of sequence. This test is performed by determining whether the difference between the pixel being processed and the preceding pixel is positive or negative and, in the case where it is positive, it initiates the local peak processing sequence, and in the case where it is negative, it initiates the local valley processing sequence. The local peak processing sequence begins with a step 63 for measuring the distance (dss) between peaks and is followed by a test step 64 to determine whether this distance (dss) is greater than a minimum value. If the answer is no, the program moves on to step 641 for processing of the next pixel and loops back between steps 61 and 62 for testing the type of sequence. If the answer is yes, if the distance (dss) is greater than the minimum distance, with the distance between peaks being represented on FIG. 9 by the value dss, the program continues on to a step 65 for calculating the percentage of variation of the peaks which determines the information (ys2–ys1) ys1, and it is ensured in the next step 66 that this variation is greater or not greater than a set value. If the answer is yes, the program continues on to a test step 691 to determine whether the variation is negative. If it is negative, the program loops back before step 61 for reading of a pixel. If the variation is positive, the program continues on to a test step 692 consisting in reading the contents of the counter of the number of products and in determining whether the contents of this counter is less than 3. If the answer is no, the program loops back before step 61 for reading of a pixel. If the answer is yes, the program continues on to a step (693) for retiming of the edge by assuming that the processed peak is in fact the true edge of the tray. This corresponds exactly to the situation where in a first stage the program has detected ys0 and then by detecting ys1 it finds that the variation for ys1 is greater than the set value of step 66 and then, checking that the number of products is less than 3, it assumes that ys1 is the true edge of the group of products to be counted. This step 693 makes it possible at the same time to position a semaphore which will be used in step 75 of the sequence of FIG. 7. If the variation is less than the set value, the program in step 67 validates the peak by incrementing a counter which counts the peaks.

This step 67 is followed by a jump to the local valley sequencer by thus sending the program back to before step 62 to process a local valley according to the following sequence. This processing always begins with test (62) involving the type of sequence and is then followed by a step for measuring the peak-valley distance (dsv) and the valley-valley distance (dvv). Following this step 621 is a test step 622 that makes it possible to determine whether the two distances are proper compared to reference values. If the answer is no, the program continues on to the processing of the next pixel represented in step 625 and is looped back before step 62. If the answer is yes, if the distances are proper, the program continues on to a step 623 for validation of the valley, which consists in incrementing a valley counter. This step is followed by a step 624 for processing a local peak while looping the program back between steps 61 and 62.

After this sequence of analysis and counting of the products for each scanning where the number of products counted is stored in step 319 for each scanning, the program executes a sequence (35) for processing the results. When the program has determined that is was an end-of-cycle step in step 34 of FIG. 3, it performs sequence 35 for processing the results, which corresponds to the sequence of steps of FIG. 7. During this processing, the program begins by performing a step 71 for sorting the results in ascending order, then constructs, in step 72, a bar chart of the results, and in step 73 searches among the results for the most frequent occurrence.

Thus, over the 100 scannings, it will be able to determine for example, that the figure 450 recurs most often in relation to the figure 439, 440, 445, and, retaining this figure 450, it will examine in step 74 the rate of success compared to a reference rate value. In the processing a fairly high success rate has been selected, but this set value can be modified if desired. If, for example, the value 450 recurs more than 7 times out of 8 countings, the program assumes that the reference rate value has been reached, and it moves on to a test step (75) to know whether there was good detection of the ends. This step 75 consists in reading the semaphore, which will have been positioned during step 693 indicating that the edges have actually been clearly detected. If the answer is no, step 751 indicates poor detection of the edges corresponding to step 50 and ends with the display (792) "no card found." If the answer is yes, the sequence continues on to a test step 76 involving the detection of the saturation of the photosensitive sensors. If the answer is yes, step 771 indicates that there is too much brightness and ends with a "too much light" display, and if the answer is no, the sequence continues on to a processing step 77 that constitutes a test to determine whether the information read had good sharpness. If the answer is no, the device displays a contrast flaw, and the sequence ends with a "no card found" display. If the answer is yes, the program ends with a test step 78 concerning the number of products to determine whether this number is greater than zero. If the answer is yes, the program ends with step 791 of displaying the number of products and the success rate.

Figure 8:
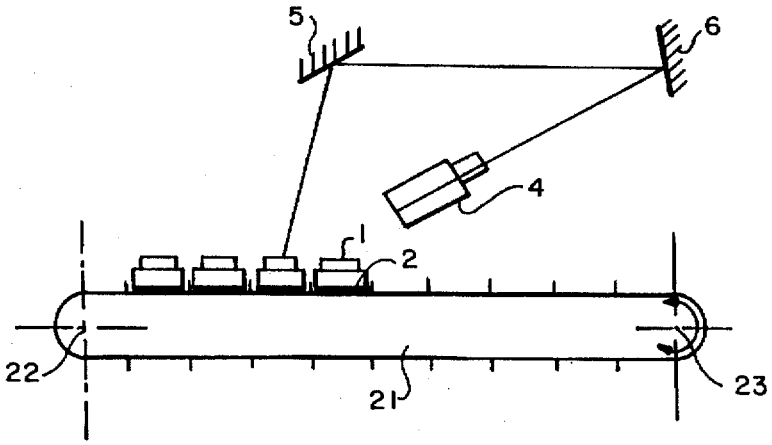
FIG. 8 shows a diagrammatic side view of another variant of the mechanical principle of the machine.

FIG. 8 shows another variant of the device for mechanical displacement of the trays under the reading beam so as to be able to perform multiple scannings in relation to the direction of displacement of trays (2). As can be seen, these trays (2) are mounted on a cleated belt (21) that is itself stretched between two drive pulleys (22, 23), at least one of which is driven in rotation by an electric motor that is powered sequentially after the processing of the 100 scanning lines or of the number of scanning lines desired to reach a sufficient success rate.

Other modifications within the grasp of a person skilled in the art are also a part of the spirit of the invention.

We claim:

1. Device for counting products that are thin, stacked side-by-side and arranged edgewise in trays packaged under a translucent shrink-on film, said device comprising:

means for illuminating a tray;

mobile shuttle means for supporting said tray, said mobile shuttle means being displaceable in a first direction of movement;

means for detecting a position of said tray on said shuttle means;

means for performing multiple scannings of said tray by a linear reading beam of a linear camera during movement of said shuttle means in said first direction of movement, said first direction of movement being perpendicular to said linear beam;

means for storing light data contained in said linear beam; and counting means responsive to each scanning for counting the number of products.

2. Counting device according to claim 1, and further comprising linear guide columns connected to said shuttle means and mounted for back-and-forth movement in said first direction, an electric motor with a drive shaft connected to said linear guide columns and means for transforming rotary movement into linear movement for displacing the tray in a back-and-forth movement in a direction perpendicular to the linear beam.

3. Counting device according to claim 1, and further including a cleated belt for supporting multiple trays driven by a continuous movement in a direction transverse to the linear read beam.

4. Counting device according to claim 1, and further including a push-button actuatable by a user for initiating movement of said shuttle means and multiple scannings during said movement.

5. Counting device according to claim 1, wherein said linear beam is reflected by a series of mirrors.

6. Counting device according to claim 1, wherein said counting means detects alternately peaks and valleys starting with a peak detection and counting peaks and volleys to produce representative and stored sine-wave signals of the linear beam of a scanning.

7. Counting device according to claim 1, wherein detection of peaks ensures detection of a first edge and a determination of peaks by measuring a distance between a preceding peak and a pixel being processed, comparing said distance with a maximum value corresponding to a thickness of a product, and calculating a percentage of variation of the peak to thereby determine the presence of an edge when said percentage variation exceeds a set value.

8. Counting device according to claim 1, wherein detection of valleys is performed in relation to a stored preceding peak by measuring the distance between the peak and a processed pixel and in relation to the stored preceding valley by measuring the distance between the valley and the processed pixel and by assuming the pixel forms a volley if the two distances are proper compared to reference values and, in the opposite case, by processing the next pixel.

9. A counting device according to claim 1, comprising means for processing the counting made for each scanning by sorting results giving the number of objects counted in ascending order and searching among said results for a most frequently occurring number and comparing the rate of success of this number to a reference rate value.

10. Counting device according to claim 1, wherein said linear camera comprises a reading bar having photosensitive elements and wherein said storage means consists of as many memory eight-bit bytes as there are photosensitive elements.

11. Counting device according to claim 10, wherein the number of photosensitive elements is at least more than twice the maximum number of objects that the device can count.

12. Counting device according to claim 10, wherein the number of photosensitive elements is equal to ten times the maximum number of objects that the device can count.

13. Counting device according to claim 10, wherein each photosensitive element makes possible detection of 256 levels of brightness which are translatable into words of one eight-bit byte constituting representation of a pixel.

14. A counting device for counting products that are thin, stacked side-by-side and arranged edgewise in trays packages under a translucent shrink-on film, comprising:

means for illuminating a tray;

mobile shuttle means for supporting said tray, said mobile shuttle means being displaceable in a first direction of movement;

means for detecting a position of said tray on said shuttle means;

means for performing at least one scanning of said tray by a linear reading beam of a linear camera during movement of said shuttle means in said first direction, said first direction being perpendicular to said linear beam, said camera including a bar of photosensitive elements;

means for storing data delivered by said bar of photosensitive elements in a memory containing as many as eight-bit bytes as there are photosensitive elements; and means for determining peaks and valleys in information contained in said memory, wherein detection of a valley is performed in relation to a stored preceding peak by measuring the distance between the peak and a processed pixel which is represented by one word of one eight-bit byte, and in relation to a stored preceding valley by measuring the distance between the valley and the processed pixel, and by assuming the pixel forms a valley if the two distances are proper compared to a reference value, and determining by the number of valleys, to thereby count the number of products.

* * * * *